United States Patent [19]

Sankaranarayanan et al.

[11] Patent Number: 4,938,278

[45] **Date of Patent: * Jul. 3, 1990**

[54] SUBSTRATE FOR USE IN SPRAY-DEPOSITED STRIP

[75] Inventors: Ashok Sankaranarayanan, Bethany; Harvey P. Cheskis, North Haven; W. Gary Watson, Cheshire, all of Conn.

[73] Assignee: Olin Corporation

[ * ] Notice: The portion of the term of this patent subsequent to Apr. 17, 2007 has been disclaimed.

[21] Appl. No.: 246,844

[22] Filed: Sep. 20, 1988

[51] Int. Cl.[5] ..... B22D 23/00

[52] U.S. Cl. ..... 164/429; 164/46; 164/479

[58] Field of Search ..... 164/46, 463, 479, 423, 164/429; 427/422, 423, 383.5; 118/302

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,608,615 | 9/1971 | Conlon | 164/87 |
| 3,727,672 | 4/1973 | Grenfell . | |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 4,512,384 | 4/1985 | Sendzimir | 164/46 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | |
|---|---|---|
| 0225732 | 6/1987 | European Pat. Off. . |
| 0225080 | 10/1987 | European Pat. Off. . |
| 1379261 | 2/1975 | United Kingdom . |
| 1472939 | 5/1977 | United Kingdom . |
| 2007129 | 5/1979 | United Kingdom . |
| 1548616 | 7/1979 | United Kingdom . |
| 1599392 | 9/1981 | United Kingdom . |
| 2172827 | 10/1986 | United Kingdom . |
| 2172900 | 10/1986 | United Kingdom . |

OTHER PUBLICATIONS

R. W. Evans et al, "The Osprey Preform Process", 1985, pp. 13–20, *Powder Metallurgy,* vol. 28, No. 1.

A. G. Leatham et al, "The Osprey Process for the Production of Spray-Deposited Roll, Disc, Tube and Billet Preforms", 1985, pp. 157–173, *Modern Developments in Powder Metallurgy,* vol. 15–17.

*Primary Examiner*—Kuang Y. Lin

[57] ABSTRACT

A molten metal gas-atomizing spray-depositing apparatus has an atomizer which employs a pressurized gas flow for atomizing a stream of molten metal into a spray pattern of metal particles and for producing a flow of the particles in the pattern thereof along with the pressurized gas flow in a generally downward direction. The apparatus also has a substrate, such as composed of stainless steel, disposed in spaced relation below the atomizer with at least an upper surface layer of a glass thereon, being thermally softenable over a broad predetermined temperature range. The pressurized gas flow impinges on the glass surface layer of the substrate which receives a deposit of the particles in the spray pattern to form a product thereon. The use of a glass which will soften over a broad predetermined temperature range but still retain a viscosity of sufficient strength to prevent it from being blown away by a pressurized atomizing gas flow and thereby maintain its capability to function as a substrate results in a reduction of porosity and an improvement of flatness of the deposit bottom surface located in contact with the glass substrate surface.

12 Claims, 1 Drawing Sheet

SUBSTRATE FOR USE IN SPRAY-DEPOSITED STRIP

BACKGROUND OF THE INVENTION

1. Field of the Invention

The present invention generally relates to spray-deposited production of a product on a moving substrate and, more particularly, is concerned with use of a substrate having a softened glass surface for reducing and improving respectively bottom strip surface porosity and flatness.

2. Description of the Prior Art

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R. W. Evans et al, *Powder Metallurgy,* Vol. 28, No. 1 (1985), pages 13–20 and "The Osprey Process for the Production of Spray-Deposited Roll, Disc, Tube and Billet Preforms" by A. G. Leatham et al, *Modern Developments in Powder Metallurgy,* Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in European Pat. Appln. No. 225,080. For producing these products, a substrate or collector, such as a flat substrate or an endless belt, is moved continuously through the spray to receive a deposit of uniform thickness across its width.

Heretofore, extensive porosity typically has been observed in a spray-deposited preform at the bottom thereof being its side in contact with the substrate or collector. This well known phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate, providing insufficient liquid to feed the inherent interstices between splatted droplets.

Another defect feature often associated with this substrate region is extensive lifting of initial splats which promotes a non-flat surface. The lifting of the splats is a consequence of solidification contraction and distortion arising from the rapid solidification of the splats.

One approach of the prior art for eliminating these problems is preheating the substrate to minimize or reduce the rate of heat transfer from the initial deposit to the substrate so that some fraction liquid is always available to feed voids created during the spray deposition process. However, it is often difficult to effectively preheat a substrate in a commercial spray deposit system because of the cooling effects of the high velocity recirculating atomizing gas. Further, preheating a substrate increases the potential for the deposit sticking to the substrate.

Therefore, a need exists for an alternative approach to elimination of the porosity problem particularly in thin gauge product produced by the above-described Osprey spray-deposition process.

SUMMARY OF THE INVENTION

The present invention provides a substrate with a softenable glass surface layer designed to satisfy the aforementioned needs. The unique approach of the present invention is to use, at least as a surface layer of the substrate, a glass which will soften over a broad predetermined temperature range but still retain a viscosity of sufficient strength to prevent it from being blown away by a pressurized atomizing gas flow and thereby maintain its capability to function as a substrate. The transition or initial softening temperature of the glass must be less than the minimum casting temperature of the metal and the glass must be able to reach an elevated temperature above the maximum temperature of the pressurized gas upon impingement while it still retains a viscosity with sufficient strength to withstand deformation due to the high pressure atomizing gas flow.

Advantageously, a substrate with such a softenable glass surface layer promotes a fully dense and highly flat bottom surface by capturing initial metal splats and preventing them from lifting from the substrate surface. Glass, having a low thermal conductivity, prevents too rapid an extraction of heat by the substrate resulting in the availability of an adequate fraction of liquid in the initial deposit layer to minimize porosity. Another advantage is that glass is a relatively inexpensive material to use.

Accordingly, the present invention is directed to a molten metal gas-atomizing spray-depositing apparatus. The apparatus includes the combination of: (a) means employing a pressurized gas flow for atomizing a stream of molten metal into a spray pattern of metal particles and producing a flow of the particles in the pattern thereof along with the gas flow in a generally downward direction; and (b) a substrate having at least an upper surface layer of glass, thermally softenable over a predetermined temperature range, being disposed below the atomizing means for impingement thereon of the pressurized gas flow and for receiving thereon a deposit of the particles in the spray pattern to form a product.

Further, the metal particles at the instance of deposit on the substrate upper surface layer are at a known minimum casting temperature; thus, the softenable glass to be usable as the substrate upper surface layer must be one that has an initial softening temperature which is below the minimum casting temperature. The pressurized gas flow at the instance of impingement on the substrate upper surface layer, before deposit of the metal particles, is at a known maximum impact temperature; thus, the softenable glass to be usable as the substrate upper surface layer must be one that retains a viscosity of sufficient strength to withstand deformation, due to the impingement by the pressurized gas flow, at a temperature which is above the maximum impact temperature.

In summary, due to the presence on the substrate of a glass being softenable over the above-defined predetermined temperature range, a reduction of porosity and an improvement of flatness of a bottom surface of the deposit located in contact therewith can be realized.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWING

In the course of the following detailed description, reference will be made to the attached drawing in which the single figure is a schematic view, partly in section, of a spray-deposition apparatus for producing a product on a moving substrate, such as in thin gauge strip form, and useful in practicing the prevent invention.

DETAILED DESCRIPTION OF THE INVENTION

Prior Art Spray-Deposition Apparatus

Figure 1:
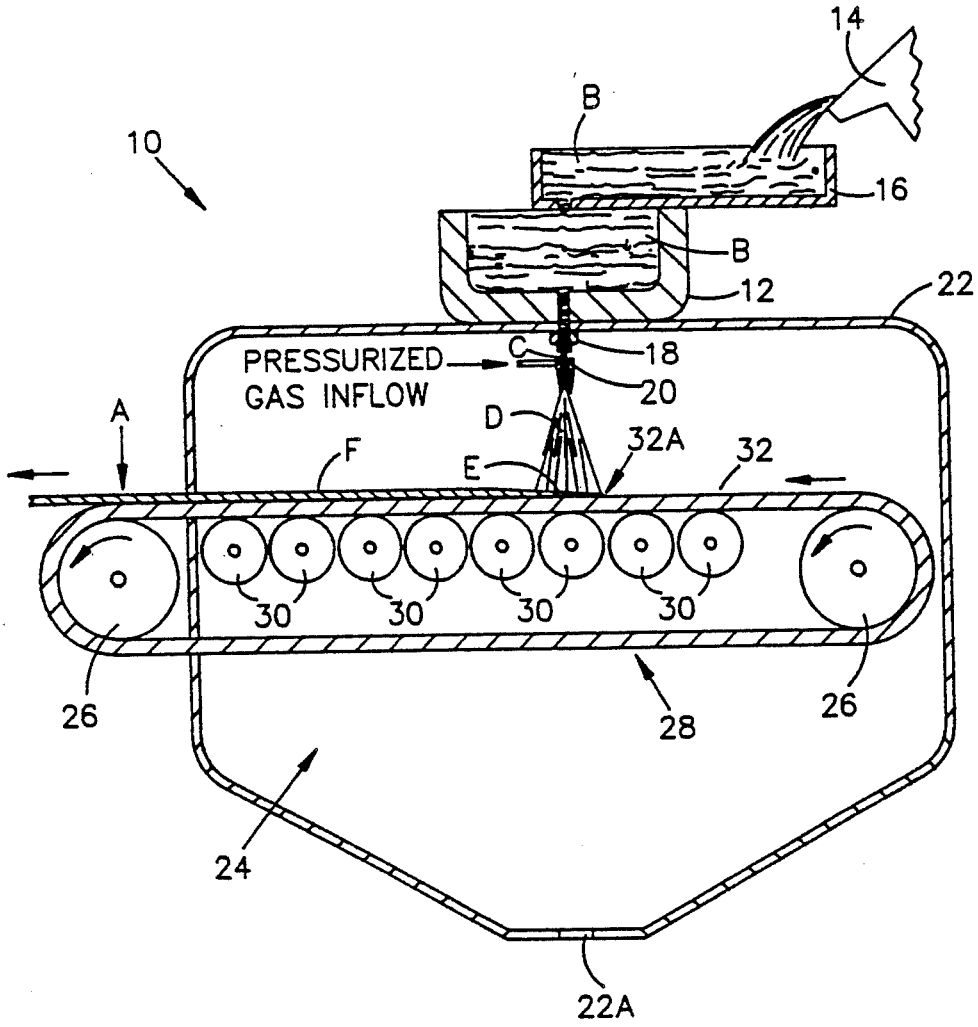

Referring now to the single figure of the drawing, there is schematically illustrated a spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12. Also, a gas atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles, broadcasting downwardly from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and a series of rollers 30 which underlie and support an upper run 32 of the endless substrate 28. The substrate 28 is composed of a suitable flexible material, such as stainless steel. An area 32A of the substrate upper run 32 directly underlies the divergent pattern of spray D for receiving thereon a deposit E of the atomized metal particles to form the metal strip product A.

The atomizing gas flowing from the atomizer 20 is much cooler than the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles overspray the substrate 28 and fall to the bottom of the spray chamber 22 where they along with the atomizing gas flow from the chamber via an exhaust port 22A.

Modifications of the Present Invention

In the prior art apparatus 10, the solid strip F formed on the substrate 28 typically exhibits extensive porosity in its bottom side adjacent the substrate. The cause of this porosity problem is believed to be due to contact with the cool substrate 28 which together with the impingement of the cooler atomizing gas extracts too much heat and thereby lowers the temperature of the spray deposit E too rapidly, starving it of a sufficient fraction of liquid to feed the interstices between splatted droplets.

The unique solution of the present invention is to employ, at least as an upper surface layer of the substrate, a glass which will soften over a broad predetermined temperature range but still retain a viscosity of sufficient strength to prevent it from being blown away by the pressurized atomizing gas flow and thereby maintain its capability to function as a substrate. The transition or initial softening temperature of the glass must be less than the minimum casting temperature of the metal particles and the glass must be able to reach an elevated temperature above the maximum impact temperature of the pressurized gas and still retain a viscosity with sufficient strength to withstand deformation due to the high pressure atomizing gas flow. Preferably, the glass should have a viscosity of $10^7$ poise or less at the minimum casting temperature, and a viscosity of $10^4$ poise or greater at the maximum temperature of the gas flow upon impingement with the glass.

A substrate with such a softenable glass surface layer promotes a fully dense and highly flat bottom surface by capturing initial metal splats and preventing them from lifting from the substrate surface. Also, the extremely low thermal conductivity of glass would clearly limit the heat transfer from the initial deposit layer E to the substrate and help ensure an adequate fraction of liquid in the initial deposit layer E to feed the interstices between the droplets and thereby minimize porosity. An additional benefit is that glass is a relatively inexpensive material to use.

The substrate may include a flexible material such as stainless steel or the like which has an upper layer of the glass.

The following example presents a range of glasses which would be appropriate for use as the substrate surface layer for spray-depositing copper alloy thereon.

Example

Assume that copper alloy will be spray cast at approximately 1200 degrees C. In accordance with the concept of the present invention, the glass selected for use as the substrate must be soft at the instance of spray casting thereon. Since glasses start softening at their respective glass transition temperatures where they have viscosities of $10^7$ poise, glasses appropriate for use as the substrate for receiving copper alloys must have a transition temperature below the minimum casting temperature of 1200 degrees C.

Also, in accordance with the concept of the present invention, glasses selected for use as the substrate when in the softened state must not be capable of being blown away by the high pressure atomizing gas flow impinging upon them just before the molten spray of metal particles are deposited on them. Assume a temperature of 600 degrees C. at impact for the pressurized gas flow. Glasses at that temperature with a viscosity of $10^4$ poise would have sufficient strength to withstand the deformation due to the gas flow. Thus, glasses appropriate for use as the substrate receiving copper alloy must have a viscosity of at least $10^4$ poise at a temperature above the maximum impact temperature of 600 degrees C.

Many glasses which will meet these requirements are given in Table I. The properties of these glasses are also summarized in the same table. Specifically, it will be noted that the initial softening temperature (at $10^7$ poise) of each glass, the lower limit of its softened temperature range, is below the minimum casting temperature of 1200 degrees C. Also, it will be noted that the elevated temperature at which each glass is of a viscosity of $10^4$, the upper limit of its softened temperature range, is above the maximum impact temperature of the gas flow of 600 degrees C.

TABLE I

| | | Temperature (Degrees C.) At Which | |
|---|---|---|---|
| No. | Glass | $10^4$ Poise | $10^7$ Poise |
| 1 | Potash Soda Glass | 980 | 630 |
| 2 | Soda Lime Glass | 1005 | 700 |
| 3 | Alumino Silicate Glass | 1200 | 915 |
| 4 | Soda Zinc Glass | 1020 | 780 |
| 5 | Boro Silicate Glass | 1080 | 700 |
| 6 | 96% Silica | 1530 | 1020 |
| 7 | Fused Silica | 1580 | 1084 |
| 8 | Titanium Silicate.Glass | 1500 | 1000 |

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. In a molten metal gas-atomizing spray-depositing apparatus, the combination comprising:
(a) means employing a pressurized gas flow for atomizing a stream of molten metal into a spray pattern of metal particles and producing a flow of said particles in said pattern thereof along with said gas flow in a generally downward direction;
(b) a substrate having at least an upper surface layer of glass, thermally softenable over a predetermined temperature range, being disposed below said atomizing means for impingement thereon by said pressurized gas flow and for receiving thereon a deposit of said particles in the spray pattern to form a product;
(c) means for moving said substrate relatively to said atomizing means; and
(d) means for separating said deposit from said substrate located downstream of said atomizing means.

2. The apparatus as recited in claim 1, wherein said substrate includes stainless steel having a layer of said glass thereon.

3. The apparatus as recited in claim 1, wherein:
said spray pattern of metal particles at the instance of deposit on said substrate upper surface layer is at a known minimum casting temperature; and
said softenable glass is one that has an initial softening temperature which is below said minimum casting temperature.

4. The apparatus as recited in claim 1, wherein:
said pressurized gas flow at the instance of impingement on said substrate upper surface layer, before deposit of said metal particles, is at a known maximum impact temperature; and
said softenable glass is one that retains a viscosity of sufficient strength to withstand deformation, due to impingement thereon by said pressurized gas flow, at a temperature which is above said maximum impact temperature.

5. In a molten metal gas-atomizing spray-depositing apparatus, the combination comprising:
(a) means employing a pressurized gas flow for atomizing a stream of molten metal into a spray pattern of metal particles and producing a flow of said particles in said pattern thereof along with said gas flow in a generally downward direction; and
(b) a substrate having at least an upper surface layer of thermally softenable glass being disposed below said atomizing means for impingement thereon of said pressurized gas flow and for receiving thereon a deposit of said particles in the spray pattern to form a product;
(c) said metal particles at the instance of deposit on said substrate upper surface layer being at a known minimum casting temperature, said softenable glass being one having an initial softening temperature below said minimum casting temperature;
(d) said pressurized gas flow at the instance of impingement on said substrate upper surface layer, before deposit of said metal particles, being at a known maximum impact temperature, said softenable glass being one retaining a viscosity of sufficient strength to withstand deformation due to said impingement by said pressurized gas flow at a temperature above said maximum impact temperature, whereby due to the presence of said softenable glass a reduction of porosity and an improvement of flatness of a bottom surface of said deposit located in contact therewith are achieved;
(e) means for moving said substrate relatively to said atomizing means; and
(f) means for separating said deposit from said substrate located downstream of said atomizing means.

6. The apparatus as recited in claim 5, wherein said softenable glass has a viscosity of $10^7$ poise or less at said minimum casting temperature and a viscosity of $10^4$ poise or greater at said maximum impact temperature.

7. The apparatus as recited in claim 5, wherein said substrate includes stainless steel having a layer of said glass thereon.

8. In a molten meal gas-atomizing spray-depositing apparatus, the combination comprising:
(a) means employing a pressurized gas flow for atomizing a stream of molten metal into a spray pattern of metal particles and producing a flow of said particles in said pattern thereof along with said gas flow in a generally downward direction;

(b) a substrate movable along a continuous path relative to said metal particles in said spray pattern thereof and having at least an outer portion of glass, thermally softenable over a predetermined temperature range, being disposed below said atomizing means for impingement thereon by said pressurized gas flow and for receiving thereon a deposit of said particles in the spray pattern to form a product; and (c) means for separating said deposit from said substrate located downstream of said atomizing means.

9. The apparatus as recited in claim 8, wherein said substrate is an endless belt composed of stainless steel and having an outer surface layer of said glass thereon.

10. The apparatus as recited in claim 8, wherein:

said spray pattern of metal particles at the instance of deposit on said substrate outer portion is at a known minimum casting temperature; and said softenable glass is one that has an initial softening temperature which is below said minimum casting temperature.

11. The apparatus as recited in claim 10, wherein:

said pressurized gas flow at the instance of impingement on said substrate upper surface layer, before deposit of said metal particles, is at a known maximum impact temperature; and said softenable glass is one that retains a viscosity of sufficient strength to withstand deformation, due to impingement thereon by said pressurized gas flow, at a temperature which is above said maximum impact temperature. 12. The apparatus as recited in claim 11, wherein said softenable glass has a viscosity of $10^7$ poise or less at said minimum casting temperature and a viscosity of $10^4$ poise or greater at said maximum impact temperature.

12. The apparatus as recited in claim 11, wherein said softenable glass has a viscosity of $10^7$ poise or less at said minimum casting temperature and a viscosity of $10^4$ poise or greater at said maximum impact temperature.

* * * * *

UNITED STATES PATENT AND TRADEMARK OFFICE

CERTIFICATE OF CORRECTION

PATENT NO. : 4,938,278

DATED : July 3, 1990

INVENTOR(S) : Sankaranarayanan Ashok, Harvey P. Cheskis and W. Gary Watson

It is certified that error appears in the above—identified patent and that said Letters Patent is hereby corrected as shown below:

On the title page, [75] Inventors:, delete "Ashok Sankaranarayanan" and insert --Sankaranarayanan Ashok--.

Column 6, Claim 8, line 64, after "molten", delete "meal" and insert --metal--.

Column 8, Claim 11, line 13, after "impact temperature.", delete "12. The apparatus as recited in...at said maximum impact temperature."

Signed and Sealed this

Nineteenth Day of May, 1992

*Attest:*

DOUGLAS B. COMER

*Attesting Officer*

*Acting Commissioner of Patents and Trademarks*